US006751928B2

(12) United States Patent
Hiramoto et al.

(10) Patent No.: US 6,751,928 B2
(45) Date of Patent: Jun. 22, 2004

(54) SPOUT INSERTION APPARATUS

(75) Inventors: Shinichi Hiramoto, Iwakuni (JP); Shoji Tsutsui, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 94 days.

(21) Appl. No.: 09/882,542

(22) Filed: Jun. 15, 2001

(65) Prior Publication Data

US 2001/0052215 A1 Dec. 20, 2001

(30) Foreign Application Priority Data

Jun. 15, 2000 (JP) ..... 2000-180632

(51) Int. Cl.[7] ..... B31B 1/90

(52) U.S. Cl. ..... 53/133.2; 53/133.1; 53/284; 53/284.1; 493/213

(58) Field of Search ..... 53/133.2, 133.1, 53/284, 284.7, 300, 308, 313; 493/213, 927, 929

(56) References Cited

U.S. PATENT DOCUMENTS

| | | | | | |
|---|---|---|---|---|---|
| 3,975,888 | A | * | 8/1976 | Jones | 53/386.1 |
| 4,648,234 | A | * | 3/1987 | Bellini | 53/67 |
| 4,732,299 | A | * | 3/1988 | Hoyt | 222/94 |
| 5,219,320 | A | * | 6/1993 | Abrams et al. | 493/8 |
| 5,581,975 | A | * | 12/1996 | Trebbi et al. | 53/284.6 |
| 5,855,544 | A | * | 1/1999 | Buchanan | 493/102 |
| 6,035,607 | A | * | 3/2000 | Miller | 53/266.1 |
| 6,045,493 | A | * | 4/2000 | Totani | 493/201 |
| 6,134,864 | A | * | 10/2000 | McGregor et al. | 53/459 |

FOREIGN PATENT DOCUMENTS

| | | | | |
|---|---|---|---|---|
| GB | 2085519 | * | 4/1982 | A44B/19/62 |
| JP | H10-202768 | | 8/1998 | |
| JP | 11-77860 | * | 3/1999 | B31B/1/90 |
| JP | H11-077860 | | 3/1999 | |
| JP | H11-333950 | | 12/1999 | |

* cited by examiner

*Primary Examiner*—Rinaldi I. Rada
*Assistant Examiner*—Gloria R Weeks
(74) *Attorney, Agent, or Firm*—Koda & Androlia

(57) ABSTRACT

An apparatus for inserting spouts into bags comprising a plurality of spout holding member disposed at equal intervals on the circumference of a continuously-rotating rotating table; and a pair of holding members which position and hold both side edges of bags, bag bottom receiving stands that support the lower ends of the bags, and suction plates which open the mouths of the bags with suction. The holding members hold side edges of supplied bags, the bag bottom receiving stand is raised to move the mouths of the bags to the suction plates, and the mouths of the bags are opened by suction by the suction plates. Then, the holding members, bag bottom receiving stand and suction plates are raised, and bags are fitted over the spouts and raised to the upper end of the sealing portion of the spouts. Afterward, the bags and spouts are temporarily sealed.

8 Claims, 10 Drawing Sheets

SPOUT INSERTION APPARATUS

BACKGROUND OF THE INVENTION

1. Field of the Invention

The present invention relates to a spout insertion apparatus which is a part of a spout-quipped bags manufacturing apparatus that attach spouts to the mouths of bags and more particularly to a spout insertion apparatus that is used to insert spouts into specified positions inside the bags in cases where such spouts are sealed or temporarily sealed to the mouths of the bags.

2. Prior Art

Japanese Patent Application Laid-Open (Kokai) No. H11-333950, for example, discloses a spout insertion means that inserts spouts into specified positions inside bags. In this prior art, spouts are inverted and supplied to holding sections that protrude downward from the circumferential edge of an intermittently rotating main rotor, bags are caused to face downward and are lowered from above, and the mouths of the bags are then opened and fitted over the spouts. In this apparatus, however, various devices with movable components such as a spout supply device, a bag supply device, an opening and lowering device, etc. are installed above the spouts held by the holding sections. As a result, there is a considerable chance that dirt, oil droplets, etc. dropping from such devices will adhere to the spouts and/or bags. Furthermore, since no means for accurately positioning the supplied bags at the centers of the spouts beforehand is provided, the positional deviation of the bags chucked by suction plates is large, and there is a danger that the ends of the bags will be caught on the deviation-preventing guide when the bags are lowered.

Japanese Patent Application Laid-Open (Kokai) No. H11-77860 discloses an apparatus in which a bag holding device and an opening device are disposed on the outer circumferential edge of a continuously rotating rotor. Supplied bags are chucked by the opening device and the mouths of the bags are opened by the opening device; and a supply of spouts is received from a spout supply device installed around the rotating rotor. In this apparatus as well, the spout supply device that has movable components are positioned above the spouts and bags; accordingly, there is a considerable chance that falling dirt, oil droplets, etc. will adhere to the spouts and/or bags. Furthermore, no sufficient disclosure is made in this prior art regarding the vertical and left-right positioning of the bags with respect to the spouts.

Furthermore, Japanese Patent Application Lid-Open (Kokai) No. H10-202768 discloses an apparatus in which a spout clamping device is disposed on the outer circumferential edge of a continuously rotating upper rotor, and a bag opening device is disposed on the outer circumferential edge of a lower rotor. Bags are supplied to the opening devices, the opening device opens the mouths of the bags, and the bags are raised and fitted over spouts held by the clamping devices. However, in this apparatus as well, a spout raising-and-lowering device is installed above the spouts held by the clamping devices; as a result, there is a considerable chance that dirt, oil droplets, etc. falling from the raising-and-lowering device will adhere to the spouts and/or bags. Furthermore, since no means for accurately positioning the supplied bags at the centers of the spouts beforehand is provided, the spouts might deviate from the centers of the bags. Moreover, though the opening device raises the bags, there is no means provided for directly restricting the raised ends of the bags. Accordingly, there is a danger of positional deviation of the sealing surfaces of the bags and spouts in the vertical direction.

SUMMARY OF THE INVENTION

Accordingly, the object of the present invention is to provide a spout insertion apparatus in which movable components are installed as far as possible in lower positions so that the adhesion of falling dirt, oil droplets, etc. to spouts and bags is prevented and also to provide a spout insertion apparatus that performs an accurate positioning of the bags and spouts.

The above object is accomplished by a unique structure of the present invention for a spout insertion apparatus which inserts spouts into specified positions inside bags, and the unique structure for the spout insertion apparatus is comprised of:

a plurality of spout holding members disposed at equal intervals on a circumference of a continuously rotating rotor so as to hold supplied spouts vertically in specified positions;

a pair of holding members, a bag bottom receiving stand, and a chucking member which are respectively disposed beneath each of the spout holding members, the pair of holding members positioning and holding both side edges of supplied bags, the bag bottom receiving stand supporting lower ends of the bags, and the chucking member opening mouths of the bags by applying suction from both sides of the bags; and a raising-and-lowering means which raises and lowers either one of the bag bottom receiving stand or the chucking member, or both of them, and wherein the mouths of the bags with side edges of the bags being held by the holding members and lower ends of the bags being supported by the bag bottom receiving stand are opened from both sides by an application of suction by the chucking member, and the bag bottom receiving stand and/or the chucking member are raised vertically with the mouths of the bags in an open state, so that the bags are raised to upper ends of sealing portion of spouts.

In the above spout insertion apparatus, either the bag bottom receiving stand which supports the lower ends of the bags or the chucking member which chucks both surfaces of the bags, or both of them, are raised in order to raise the bags to the upper ends of the sealing portions of the spouts. When the chucking member is raised, the bags can be raised in an open state by the chucking member. On the other hand, when only the bag bottom receiving stand is raised, the chucking member must be removed from the surfaces of the bags after the mouths of the bags are opened; therefore, it is desirable that a means for maintaining the open state of the bags effected by the chucking member while the bags are raised be separately installed, such a means for maintaining the open state of the bags being, for instance, an air nozzle which rotates together with a rotor and blows air into the bags form above.

Furthermore, in cases where the spouts are long so that the amount by which the bags must be raised is a considerable amount, it is desirable to arrange so that the holding members is also raised and lowered, and the holding members are raised as well when the bag bottom receiving stand and/or the chucking member are vertically raised with the bags in an open state.

In the above spout insertion apparatus, the following structures may be cited as desirable working configurations:

(1) A raising-and-lowering means which raises and lowers the bag bottom receiving stand is provided, so that the mouths of the bags are opened from both sides by the chucking member after the bag bottom receiving stand that supports the lower ends of the bags has been raised a specified distance and the mouths of the bags are raised to the position of the chucking member;

(2) Raising-and-lowering means which raise both the bag bottom receiving stand and the chucking member are provided for these components, a contact member which contacts the upper ends of the raised bags is disposed in the lower portions of the spout holding members, the bag bottom receiving stand elastically supports the bags, and the suction chucking of the chucking member is stopped immediately before the bags reach the upper end;

(3) When the chucking member opens the mouths of the bags by applying suction from both sides, the pair of holding members narrow the gap between the holding members by a specified distance;

(4) The holding members have a substantially V shape when viewed from above and have a specified length in the vertical direction. The holding members are attached to the tip ends of respective pivoting arms and are disposed so as to face each other. In addition, the holding members open and close by swinging through a specified range so that they receive bags when opened and hold both side edges of the bags when closed; and (5) A common raising-and-lowering means is provided so as to raise and lower the holding members and the chucking member at the same time.

The spout holding members in the present invention can be of various configurations. They can be of the type that holds the groove portions located between the flanges of the spouts. They can hold the flanges or the head portions of the spouts.

In the spout insertion apparatus of the present invention, after the spouts have been inserted into specified positions in the bags, the sealing portions of the spouts and bags are sealed or temporarily sealed.

DETAILED DESCRIPTION OF THE INVENTION

The spout insertion apparatus of the present invention will be described in concrete terms with reference to the accompanying drawings.

Figure 1:
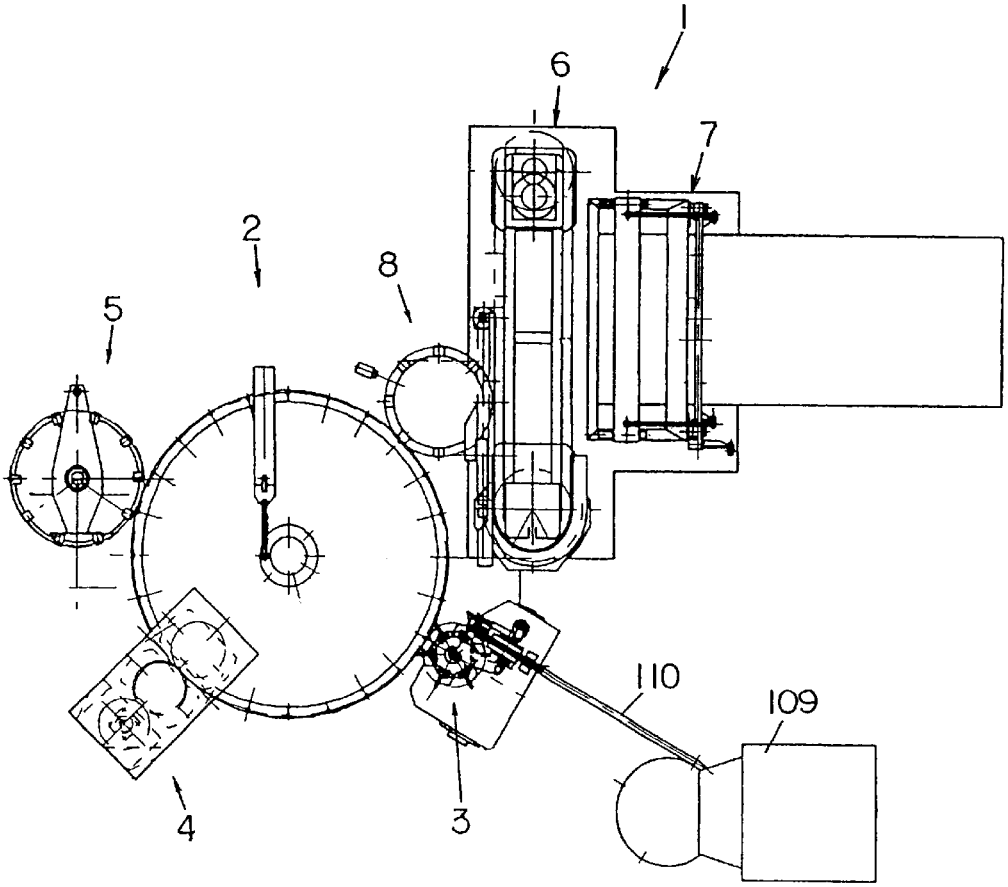
FIG. 1 is a schematic top view of the insertion apparatus of the present invention and related devices.
Figure 2A:
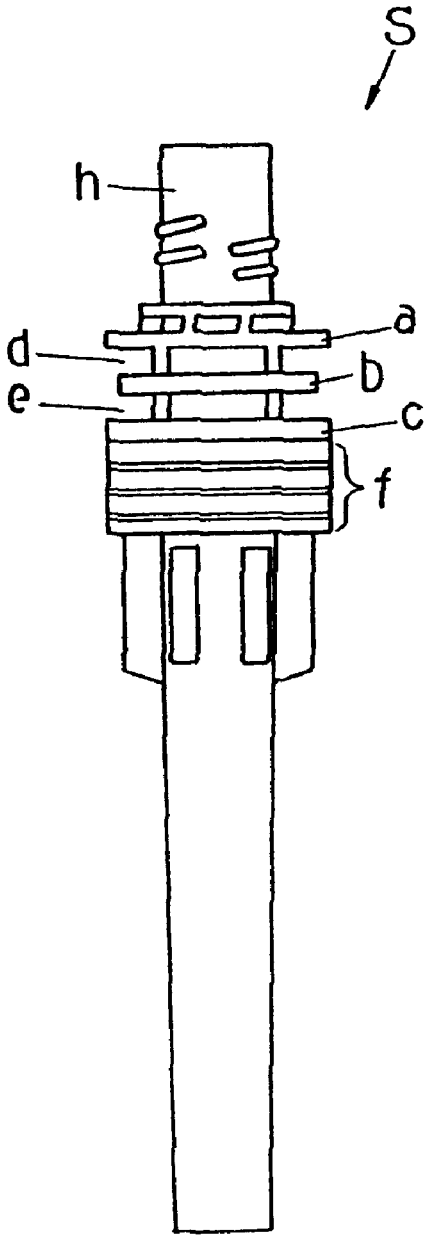
FIG. 2A shows a front view of one of the spouts.
Figure 2B:
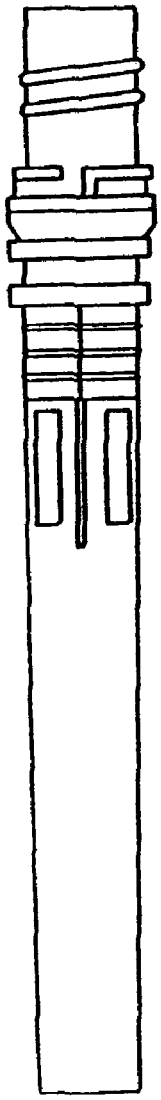
FIG. 2B is a side view thereof.

FIG. 1 is a top view of the spout insertion apparatus and surrounding devices. Bags are supplied to the spout insertion apparatus 2 from a continuous bag-supplying apparatus 1, and spouts S (see FIGS. 2A and 2B) are supplied to the spout insertion and temporary-sealing apparatus 4 from a spout-supplying apparatus 3. Inside the spout insertion apparatus 2, the bags are fitted over the spouts (in other words, the spouts are inserted into the bags), the sealing portions are temporarily sealed by a temporary-sealing apparatus 4, and the bags and spouts are joined to each other. Then, the bags with attached spouts are transferred to a main-sealing apparatus (not shown) via an intermediate rotor 5. Furthermore, in the spouts S, a, b and c indicate flanges, and one or the other of the groove portions d and e between the flanges is clamped by the spout holding members 26 described below. The groove portions d and e are formed entirely from flat surfaces. In addition, f refers to sealing portions.

The continuous bag-supplying apparatus 1 may be the same as the continuous bag-supplying apparatus described in the U.S. patent application Ser. No. 09/523,856 filed by the applicant of the present application. The continuous bag-supplying apparatus 1 comprises a bag conveying device 6, bag supply devices 7 and a transfer device 8. The bag conveying device 6 conveys a plurality of bag holding members disposed at equal intervals in one direction along an annular track that has a pair of parallel sections. In this case, on one side of the parallel sections, the bag holding members are conveyed intermittently, with each conveying movement being for a distance that is an integral multiple of the attachment spacing of the bag holding members, while on the other side of the parallel sections, the bag holding members are continuously conveyed at a constant speed. A plurality of bag supply devices 7 are lined up in a row on the upstream side of the bag conveying device 6 (i.e., on the first side of the parallel sections); the bag supply devices intermittently supply a plurality of bags to the bag holding members at the same time. The transfer device 8 is disposed on the downstream side of the bag conveying device (i.e., on the second side of the parallel sections); the transfer device 8 continuously receives bags from the bag holding members, and continuously supplies the bags to the bag holding means (holding members and bag bottom receiving stand described later) of the spout insertion apparatus 2. Known continuous bag-supplying apparatuses other than the continuous bag-supplying apparatus 1 may be used in order to supply bags continuously to the bag holding means of the spout insertion apparatus 2.

Here, the continuous bag-supplying apparatus 1 will be described with reference only to the transfer device 8 which has a direct connection with the spout insertion apparatus 2.

Figure 3:
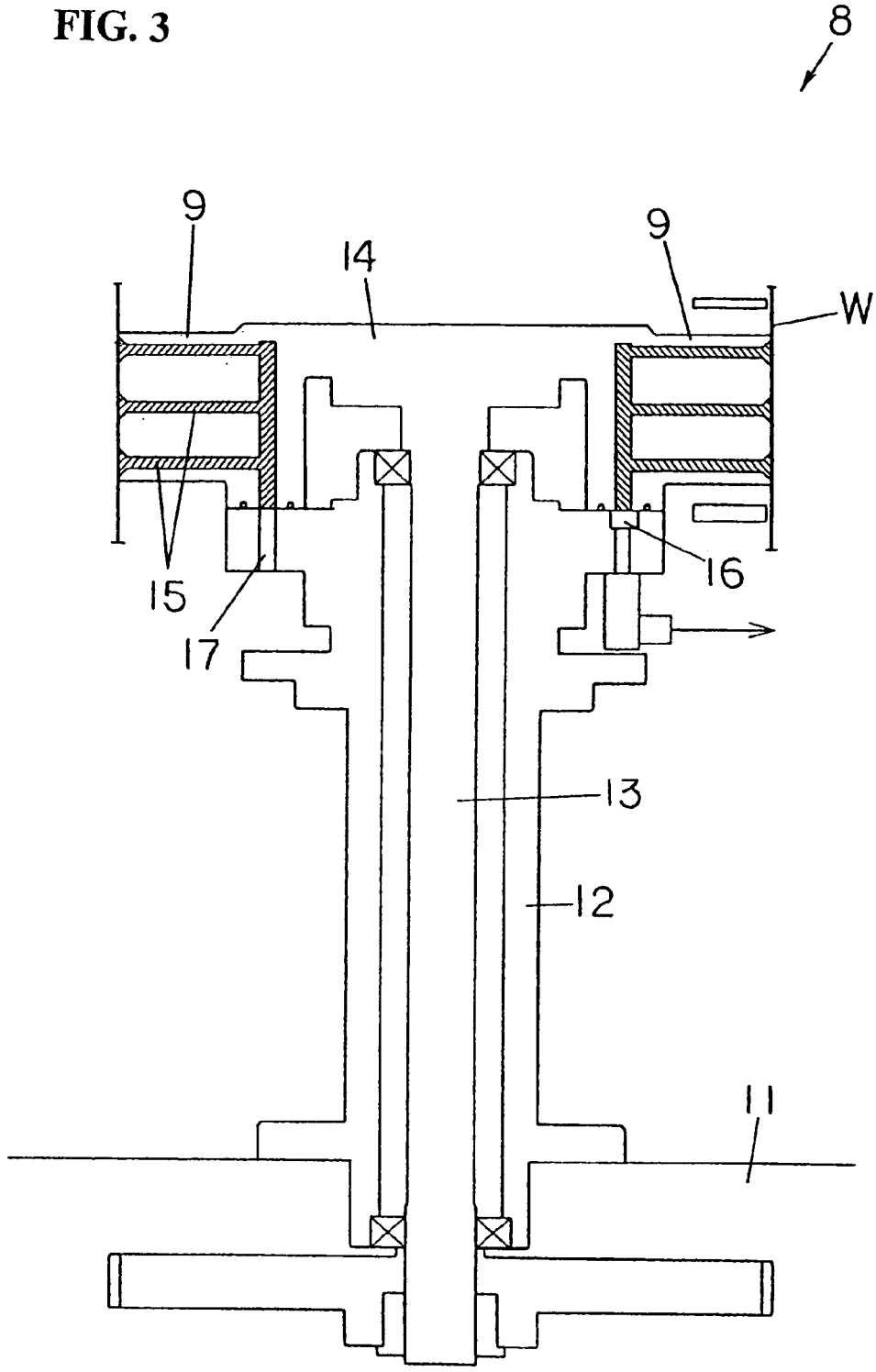
FIG. 3 is a sectional view of the transfer device.

As shown in FIG. 3, the transfer device 8 is a rotary type transfer device equipped with a plurality of transfer means 9 disposed at equal intervals (intervals that are the same as the attachment spacing of the bag holding members of the bag conveying device 6) on the outer circumference of the transfer device 8. The transfer device 8 is equipped with a supporting stand 12 which is installed in an upright position on a base 11, and a rotor 13 which is caused to rotate continuously by a driving motor (servo motor) that is not shown. Transfer means 9 that chuck bags W by means of vacuum suction are formed on the circumferential surface of the rotor head 14, and vacuum passages 15 formed in the rotor head 14 open in the side surfaces of the transfer means 9. From a position facing the bag conveying device 6 to a position in which the rotor has completed ⅝ of a revolution, the vacuum passages 15 communicate with a vacuum pump (not shown) via a vacuum port 16 formed in the supporting stand 12; then, at the position where the rotor has completed ⅝ of a revolution, the vacuum passages 15 communicate with an atmosphere release port 17.

The transfer means 9 of the transfer device 8 continuously rotate in the horizontal plane at the same speed and timing as the bags W that are continuously conveyed along the second side of the parallel sections of the bag conveying device 6. Bags W are chucked and continuously received by the transfer means 9 and are then transferred to the spout insertion apparatus 2 when ⅝ of a revolution has been completed.

The insertion apparatus 2 is a rotary type apparatus. As seen from FIGS. 4 through 6, a table rotating shaft 22 is supported inside a supporting stand 21 which is rotatably installed in an upright position on a base 11. A rotating table (rotor) 23 is fastened to the table rotating shaft 22, and spout holding member 26 are attached to the outer circumference at equal intervals (intervals that are the same as the installment spacing of the transfer means 9 of the transfer device 8) via upright attachment supporting columns 24 and attachment plates 25. The rotating table 23 rotates continuously, and is set so that the spout holding member 26 and transfer means 9 rotate at the same speed and timing. As best seen from FIGS. 7A and 7B, the spout holding member 26 are fork-shaped members which have a clamping groove 26*a* that faces outward in the radial direction, and that clamps the groove portion between the flanges of the corresponding spout S. A tapered surface that opens outward is formed at the entry point of the clamping groove 26*a*. The attachment plates 25 are annular members; recessed parts 25*a* are formed in the attachment plates 25 so that the attachment plates 25 do not interfere with the clamping of the spouts in the areas of the spout holding members 26. Furthermore, the attachment plates 25 also function as stopper members that are contacted by the upper ends of the bags so that the rising ends of the bags are checked.

A pair of holding members 31, a bag bottom receiving stand 32 and a pair of suction plates 33 are respectively disposed beneath each spout holding member 26.

The holding members 31 are substantially V-shaped when viewed in a plan view. Each of the holding members 31 is comprised of an inner claw 31*a* and an outer claw 31*b*. The holding members 31 have a specified length in the vertical direction and are attached to the tip ends of respective pivoting holding arms 34 and 35. The holding members 31 open and close by swinging through a specified range. In an open state, the holding members 31 receive the bags W; and the holding members 31 then close so as to hold both side edges of the bags W. The inner claws 31*a* have rectilinear holding surfaces that run more or less along the tangent of the rotational track of each inner claw 31*a*, while the outer claws 31*b* have holding surfaces that face slightly outward. The pairs of claws are installed facing each other, and the spacing between the inner claws 31*a* of the respective holding members 31 is set so that this spacing is narrower than the spacing of the outer claws 31*b*. Furthermore, the holding members 31 have cut-outs in two places, i.e., above and below; and bag introduction guides 36 and 37 which are disposed above and below the transfer means 9 of the transfer device 8 are positioned at the cutouts.

Gears 38 and 39 are interposed between the holding arms 34 and 35 so that the holding arms 34 and 35 simultaneously pivot in an opening and closing action.

The holding arm 34 is pivotably held on a raising-and-lowering holder 41 via a bearing 42 (inner race 42*a* and outer race 42*b*), and an arm-swinging fulcrum shaft 43 is inserted into the inner race 42*a*. Longitudinal ribs are formed on the outer circumferential surface of the arm-swinging fulcrum shaft 43, and longitudinal grooves which accommodate the longitudinal ribs so that the ribs are free to slide are formed on the inner circumferential surface of the inner race 42*a*, thus allowing the bearing 42 (and raising-and-lowering holder 41) to rise and fall relative to the arm-swinging fulcrum shaft 43. On the other hand, the holding arm 35 is arranged so that it can to pivot with respect to the raising-and-lowering holder 41 via an arm-swinging fulcrum shaft 44.

A raising-and-lowering slider 45 is fastened to the inside-diameter side of the raising-and-lowering holder 41 (center side of the rotating table 23). The raising-and-lowering slider 45 slides along a raising-and-lowering rail 47 that is vertically installed on a bracket 46 attached to the undersurface of the rotating table 23. Furthermore, a cam roller 48 is disposed on the inside of the slider 45. As the rotating table 23 rotates, the cam roller 48 runs through the cam groove of an annular raising-and-lowering cam 49 that is attached to the supporting stand 21. As a result, the raising-and-lowering holder 41 is (along with the holding members 31) raised and lowered.

The arm-swinging fulcrum shaft 43 is pivotally supported by a bearing 51 in the vicinity of the lower end of the arm-swinging fulcrum shaft 43. The bearing 51 is attached to a supporting plate 52 which is fastened to the lower end of the bracket 46. A swinging arm 53 is fastened to the lower end of the swinging-arm fulcrum shaft 43, and the swinging arm 53 is connected via a connecting rod (not shown) to one end of a cam lever 55 which is shaft-supported on a bracket 54 on the undersurface of the supporting plate 52 so that the cam lever 55 can swing (in a relationship which is such that swinging arm 53 swings in the horizontal plane when the cam lever swings). A cam roller 56 is disposed on the other end portion of the cam lever 55, and the cam roller 56 runs through the cam groove of an annular opening-and-closing cam 57 as the rotating table 23 rotates. As a result, the swinging arm 53 swings and the arm-swinging fulcrum shaft 43 pivots so that the holding arms 34 and 35 swing and the holding members 31 open and close.

The opening-and-closing cam 57 is fastened to the outer circumference of an annular attachment bracket 58. A plurality of female screw members 59 are disposed on the circumference of the attachment bracket 58, and rotating shafts 62 which are rotatably supported on a stand 61 disposed on the base 11 are engaged with the female screw members 59, so that the attachment bracket 58 is supported in a horizontal position. Gears 63 are attached to the lower ends of the rotating shafts 62, and the gears engage with the outer circumference of an intermediate gear 64 which is rotatably attached to the table rotating shaft 22. A sprocket 65 is fastened to one of the gears 63. The sprocket 65 is connected via a chain 66 and sprocket 67 to a rotating shaft 69 which is rotatably supported on a stand 68 disposed on the base 11. Accordingly, when a handle 71 fastened to the rotating shaft 69 is turned, the plurality of rotating shafts 62 are rotated by the same amount, and the bracket 58 and opening-and-closing cams 57 are raised and lowered while maintaining a horizontal attitude. The height of the opening-and-closing cams 57 is adjusted in accordance with the width of the bags.

A bag bottom receiving stand 32 is disposed beneath each pair of holding members 31. The bag bottom receiving stand 32 has a receiving section which is substantially V-shaped as seen in a side view, and is elastically supported on a receiving stand holder 72 via a supporting shaft 73 and compression spring 74; the receiving stand holder 72 is fastened to a receiving stand attachment plate 75 by a high adjustment screw 76. A raising-and-lowering slider 77 is fastened to the receiving stand attachment plate 75. Furthermore, a raising-and-lowering rail 79 is fastened in a vertical position to a bracket 78 which is attached to the raising-and-lowering holder 41, and the raising-and-lowering slider 77 slides along the raising-and-lowering rail 79. A cam roller 81 is attached to the lower end of the receiving stand attachment plate 75. As the rotating table 23 rotates, the cam roller 81 runs over an annular receiving stand raising-and-lowering cam 83 that is attached to the base 11 via a bracket 82. As a result, the bag bottom receiving stand 32 is raised and lowered.

In the meantime, when bags of different lengths are processed, it is necessary to adjust the height of the bag bottom receiving stand 32. This adjustment can be done by means of the height adjustment screw 76. Variation in the length of bags that have the same nominal length is absorbed by elastic deformation of the compression spring 74.

A pair of suction plates 33 are positioned above the holding members 31. The respective suction plates 33 are attached facing the tip ends of opening arms 86 and 87 that are free to swing in the horizontal plane about respective swinging fulcrum shafts 84 and 85, and the suction plates 33 simultaneously pivot in an opening-and-closing action via gears 88 and 89. The swinging fulcrum shafts 84 and 85 are fastened to an attachment base 91 that s disposed on the upper end of the bracket 78, so that the suction plates 33 are raised and lowered together with the raising-and-lowering holder 41 (and with the holding members 31). The opening arms 86 and 87 are constantly driven in the opening direction by a compression spring 92, and the opening distance of the opening arms 86 and 87 is restricted by a stopper 93 that is attached to the attachment base 91. Meanwhile, a cam roller 94 is attached to the opening arm 86. The cam roller 94 contacts an opening arm swinging cam 95 which is disposed over a specified distance along the outer circumference of the rotating table 23, and it closes the opening arms 86 and 87 and suction plates 33.

A rotary valve is disposed on the upper portion of the table rotating shaft 22. The rotary valve is comprised of a rotating valve 96 which is fastened to the rotating table shaft 22 and a fixed valve 97 which is rotatably attached to the table rotating shaft 22. The fixed valve 97 is fixed in place by means of rotation-stopping rod 98, etc. and is elastically pressed against the rotating valve 96 by a pressing plate 99; furthermore, the fixed valve 97 is connected to a vacuum source in a connecting part 101. Furthermore, the suction plates 33 are connected to respective vacuum ports 102 of the rotating valve 96; as the rotating table 23 rotates, the vacuum ports 102 are placed in communication with vacuum ports formed in the fixed valve 97 and then released from communication with the vacuum ports. Furthermore, a table rotating gear 103 which is connected to a driving source (not shown) is fastened to the lower portion of the table rotating shaft 22.

Figure 4:
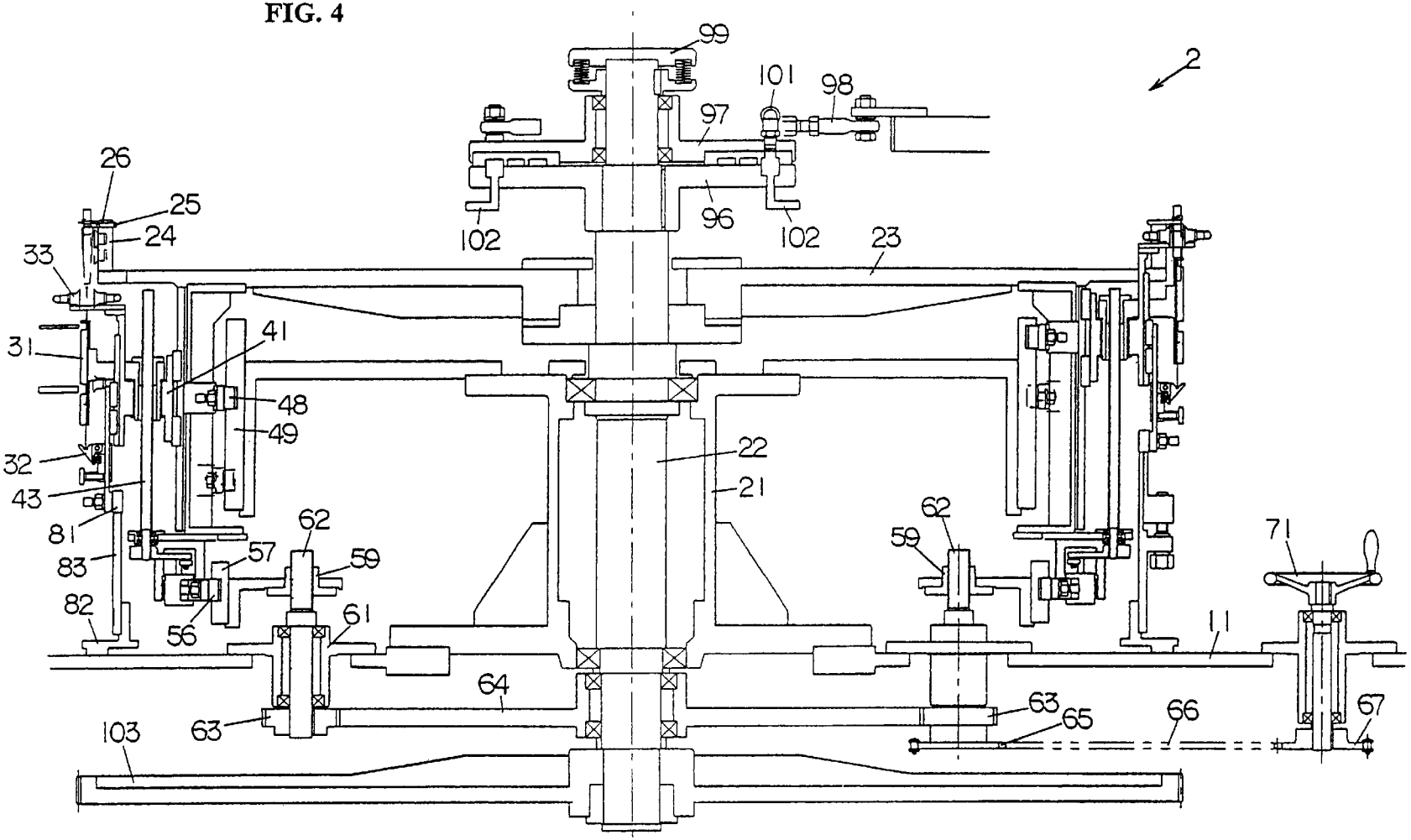
FIG. 4 is a sectional view of the insertion apparatus.
Figure 5:
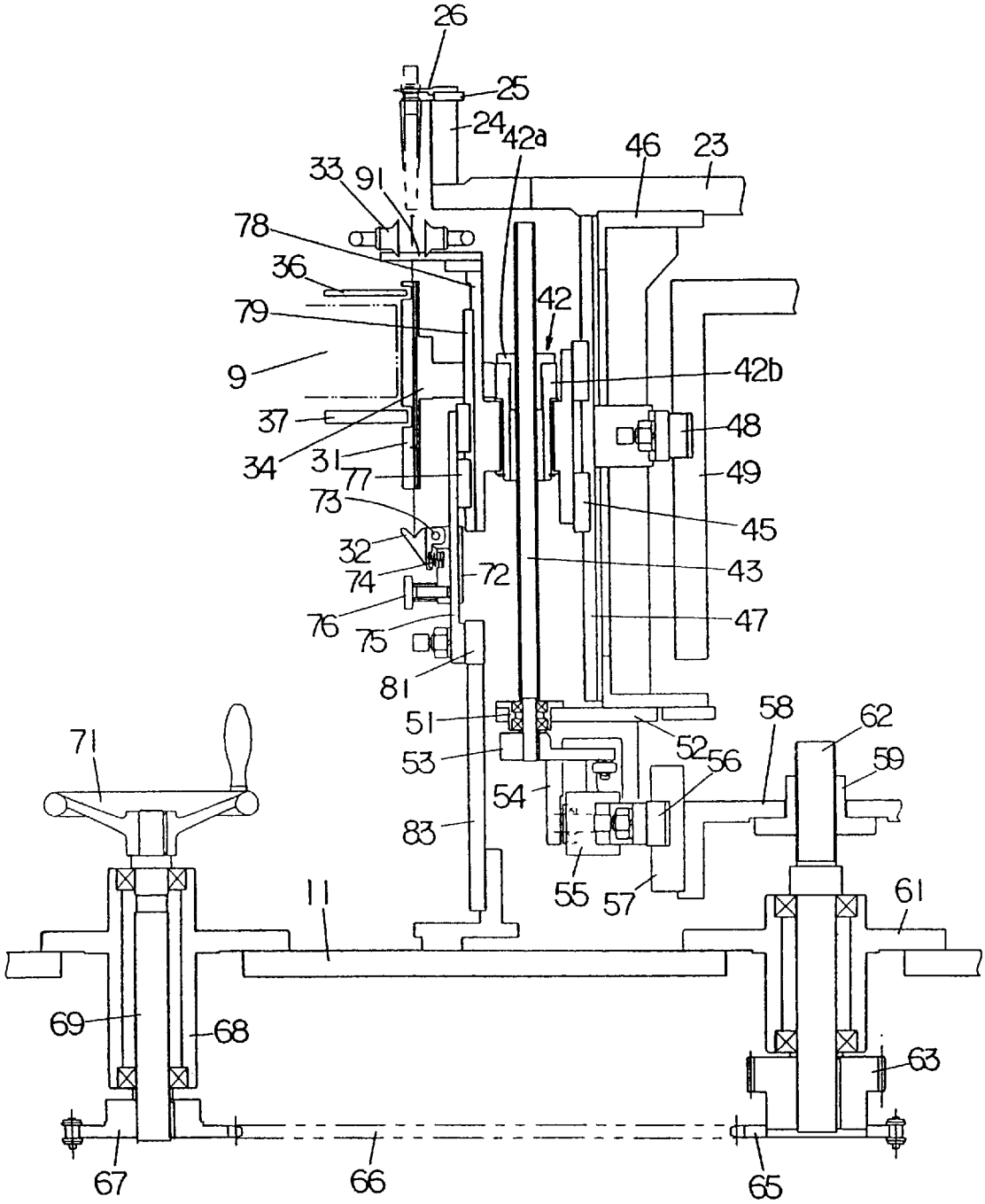
FIG. 5 is an enlarged sectional view of the insertion apparatus.
Figure 6B:
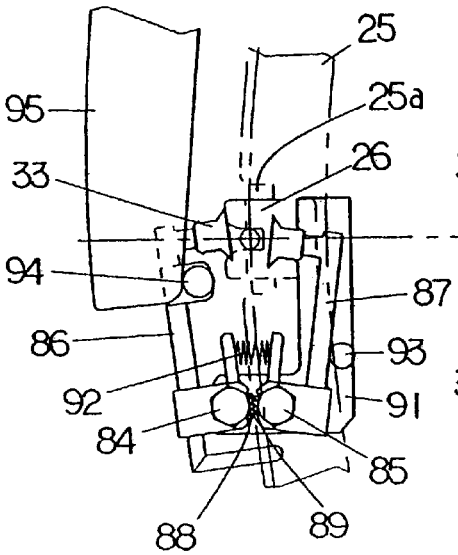
FIG. 6B is a partial top view which illustrates the opening-and-closing mechanism of the suction plates.
Figure 6A:
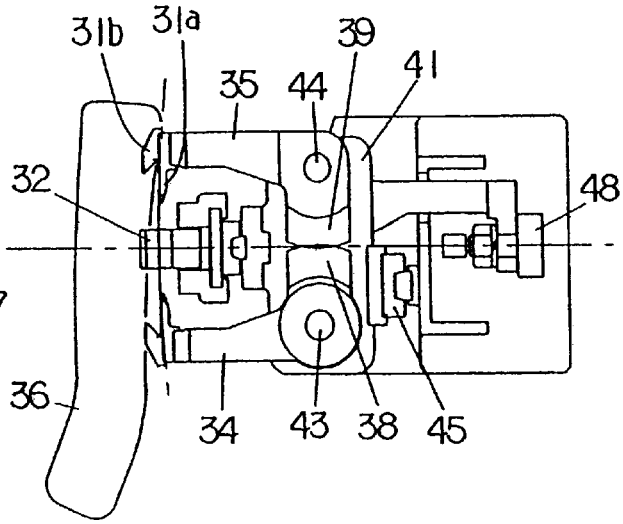
FIG. 6A is a partial top view which illustrates the opening-and-closing mechanism of the holding members.

In addition, though not shown in FIGS. 4 and 5, a temporary-sealing back-up device (described later) is installed on the rotating table 23.

Next, the spout supply device 3 will be described with reference to FIGS. 7A and 7B.

Figure 7A:
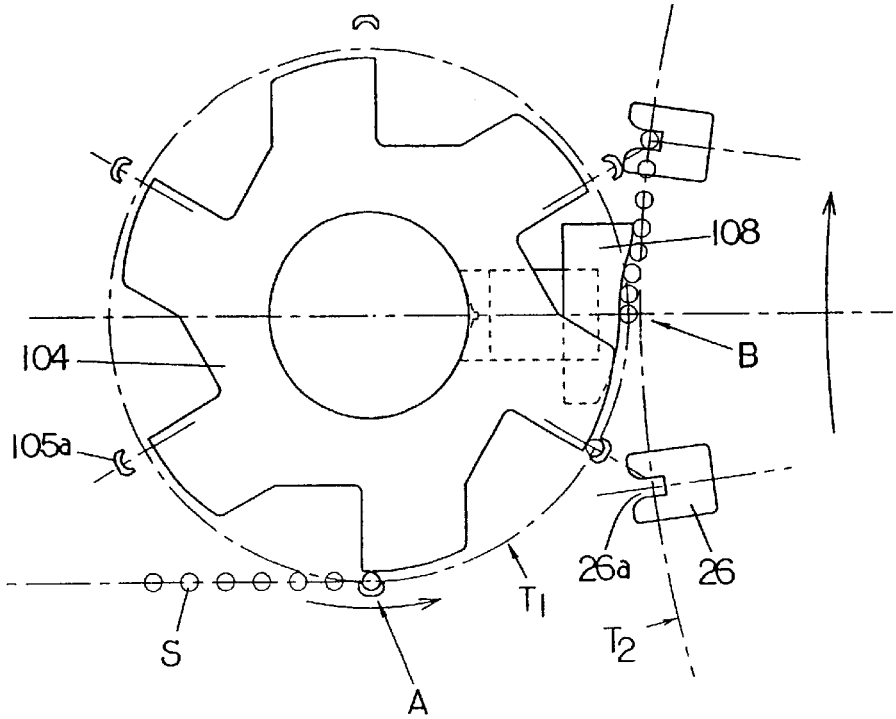
FIG. 7A is a schematic top view of the transfer of spouts by the spout supply device.
Figure 7B:
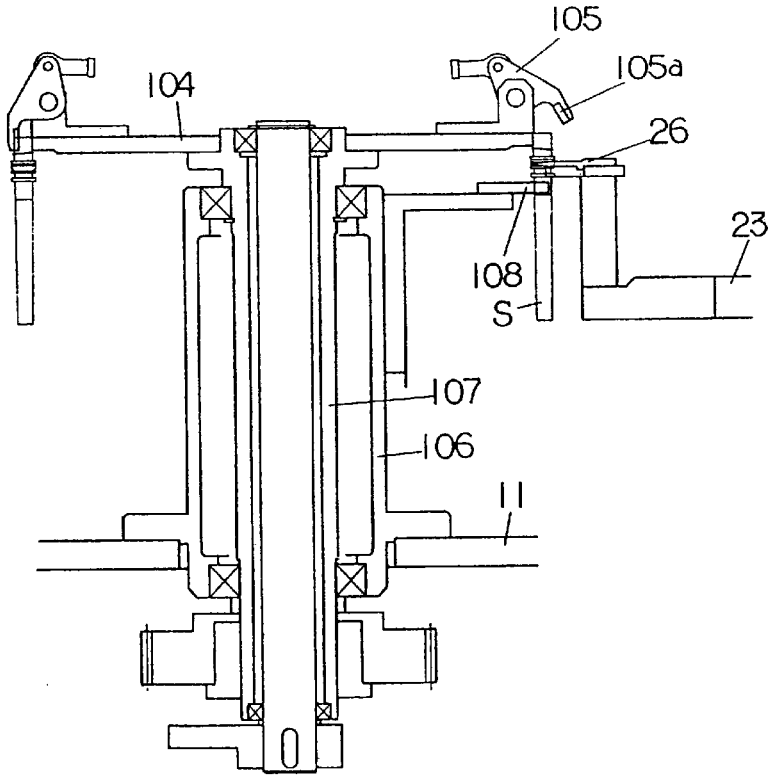
FIG. 7B is a sectional side view thereof.

The spout supply device 3 is a rotary type supply device in which a plurality of gripping members 105 (only the gripping claws 105*a* are shown in FIG. 7A) that are free to open and close are installed at equal intervals on the outer circumference of a rotating table 104. The rotating table 104 is disposed on a rotating shaft 107 which rotates inside a supporting stand 106 that is installed in an upright position on the base 11, and a push-in guide 108 which pushes spouts out toward the grooves 26*a* of the spout holding members 26 is disposed on the supporting stand 106. Furthermore, the gripping members 105 are opened and closed at a specified timing by a mechanism that is not shown as the rotating table 104 rotates.

In this spout supply device 3, spouts S are guided in a single row over spout supplying rails 110 from a parts feeder 109, and the leading spout S is stopped and positioned at the exit point of the spout supplying rails 110. The rotating table 104 rotates intermittently a specified angle (60°) at a time in a cycle consisting of stopping, acceleration, constant speed, deceleration and stopping. When the rotating table 104 stops, the spout gripping members 105 stop in the receiving position A of the positioned spout S, and the head portion h of the positioned leading spout S is gripped between the gripping claw 105*a* and the outer circumference of the rotating table 104.

Meanwhile, the conveying track $T_1$ of the centers of the spout holding positions of the spout gripping members 105 is set so that it approaches the conveying track $T_2$ of the centers of the spout holding positions of the spout holding members 26. It is arranged so that the rotating table 104 rotates at a constant speed in the vicinity of the transfer position B where the spouts are transferred to the spout holding members 26 (i.e., the position where both conveying tracks are in closest proximity to each other) and so that the spout gripping members 105 rotate at the same speed as the spout holding members 26 with the spout gripping members 105 and the spout holding members 26 running side by side. During this period of constant-speed rotation, the spouts S gripped by the spout gripping members 105 are introduced into the clamping grooves 26*a* (tapered portions) of the spout holding members 26. After the spouts S have been introduced into the clamping grooves 26*a* of the spout holding members 26 (i.e., at the spout transfer position B or slightly before the spout transfer position B), the spout gripping members 105 open and release the spouts S.

The spouts S held by the spout holding members 26 contact the push-in guide 108 at a point prior to the transfer position B; and as the spout holding members 26 rotate, the spouts S are guided by the push-in guide 108, and are pushed in to the centers of the spout holding positions of the clamping grooves 26*a*.

Figure 8A:
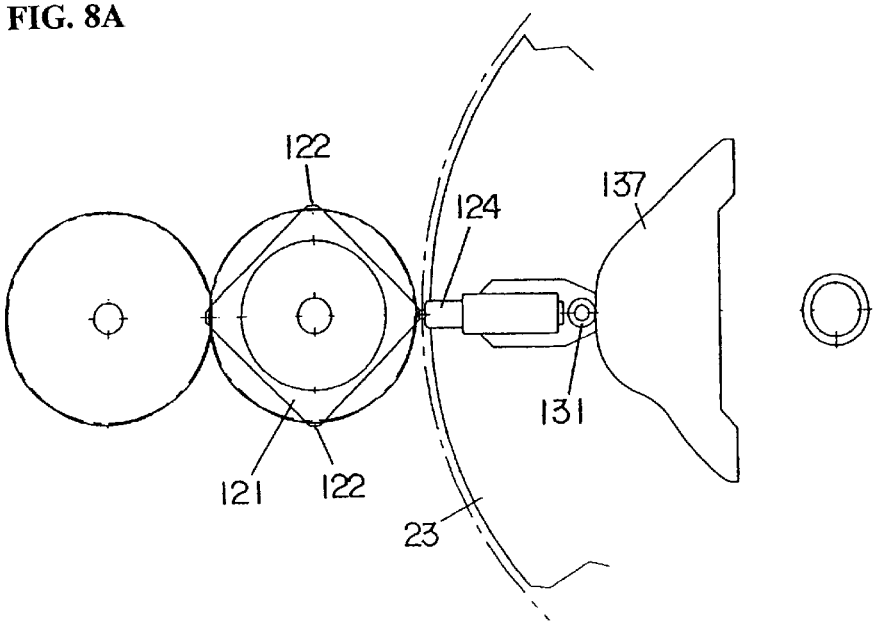
FIG. 8A is an explanatory top view of the temporary-sealing apparatus.
Figure 8B:
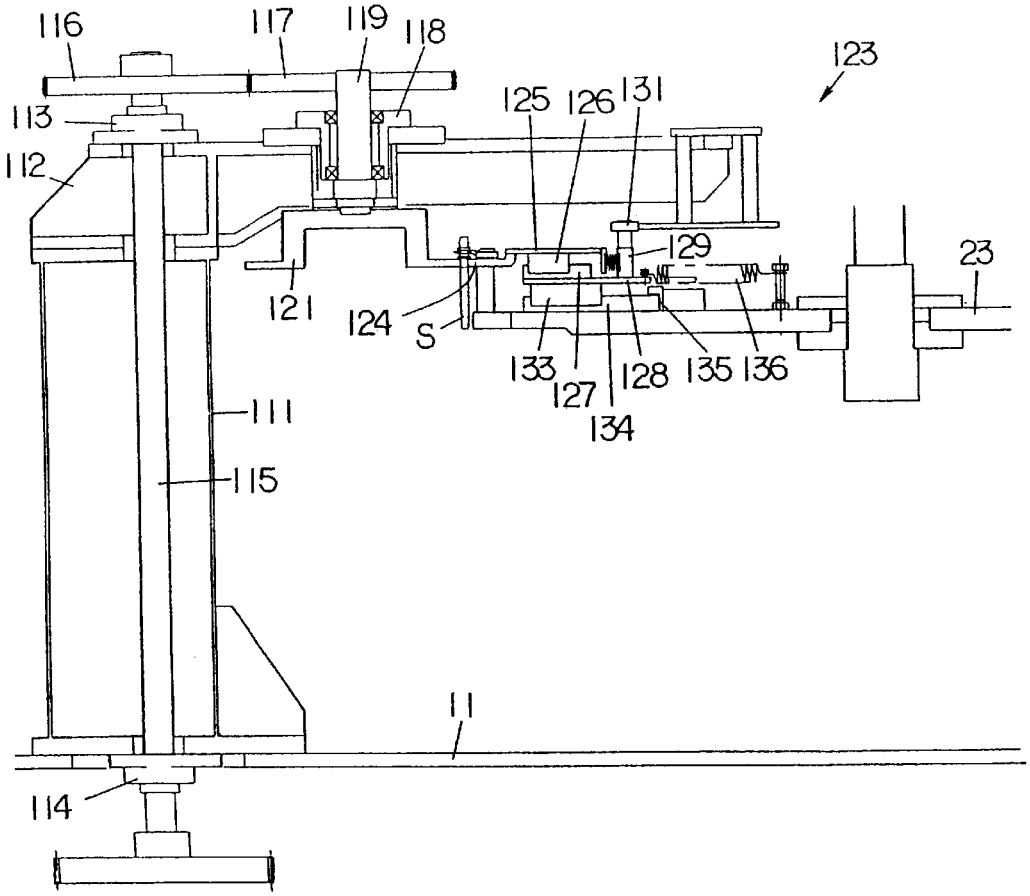
FIG. 8B is an explanatory sectional view thereof.

Next, the temporary-sealing apparatus 4 will be described with reference to FIGS. 8A and 8B.

The temporary-sealing apparatus 4 is equipped with, along with other components, a supporting stand 111 which is installed in an upright position on the base 11, a frame 112 which is attached to the upper part of the supporting stand 111, a rotating shaft 115 which is supported on bearings 113 and 114, a holding shaft 119 which is supported on a bearing 118 and is caused to rotate via gears 116 and 117, and a temporary-sealing shaft 121 which is attached to the lower end of the holding shaft 119. The temporary-sealing body 121 has temporary-sealing portions 122 installed at equal intervals around its circumference and is heated by a heater (not shown). As the temporary-sealing body 121 rotates, the temporary-sealing portions 122 rotate with a timing that is matched to the spout holding members 26 of the rotating table 23, and the temporary-sealing portions 122 are pressed against the sealing portions of the spouts S held by the spout holding members 26. At this position, bags W are fitted over the spouts S, and the sealing portions of the bags W and sealing portions of the spouts S are temporarily sealed.

Furthermore, the temporary-sealing apparatus is equipped with a back-up device 123 which supports from the inside the spouts S that are pushed inward by the temporary-sealing portions 122.

The back-up device 123 comprises individual sections and a common section. The individual sections are disposed on the rotating table 23 so as to positionally correspond to the respective spout holding members 26. Each of the individual sections comprises: a retaining plate 124 that backs up the corresponding spout, an attachment plate 125 for the retaining plate 124, a slider 126 that is disposed on the undersurface of the attachment plate 125, a slide rail 127 for the slider 126, an intermediate plate 128 to which the slide rail 127 is attached, a supporting shaft 129 and cam roller 131 that are disposed on the intermediate plate 128, a compression spring 132 that is interposed between the attachment plate 125 and the supporting shaft 129, a slider 133 that is disposed on the undersurface of the intermediate plate 128, a slide rail 134 for the slider 133, a stopper 135 for the slider 133, and a tension spring 136 that drives the intermediate plate 128 toward the inner circumference, etc. The common section is comprised of a back-up cam 137 attached to the frame 112, etc. As the rotating table 23 rotates, the cam rollers 131 run along the circumferential surface of the back-up cam 137.

The respective retaining plates 124 are pulled inward by the action of the tension springs 136 until they rotate into the temporary-sealing position. When the retaining plates 124 reach the temporary-sealing position, the cam rollers 131 are pushed by the back-up cam 137, and the cam rollers 131 move toward the outer circumference, thus causing the retaining plates 124 to advance toward the outer circumference and contact the spouts S, so that the retaining plates 124 back up the spouts S.

Figure 9:
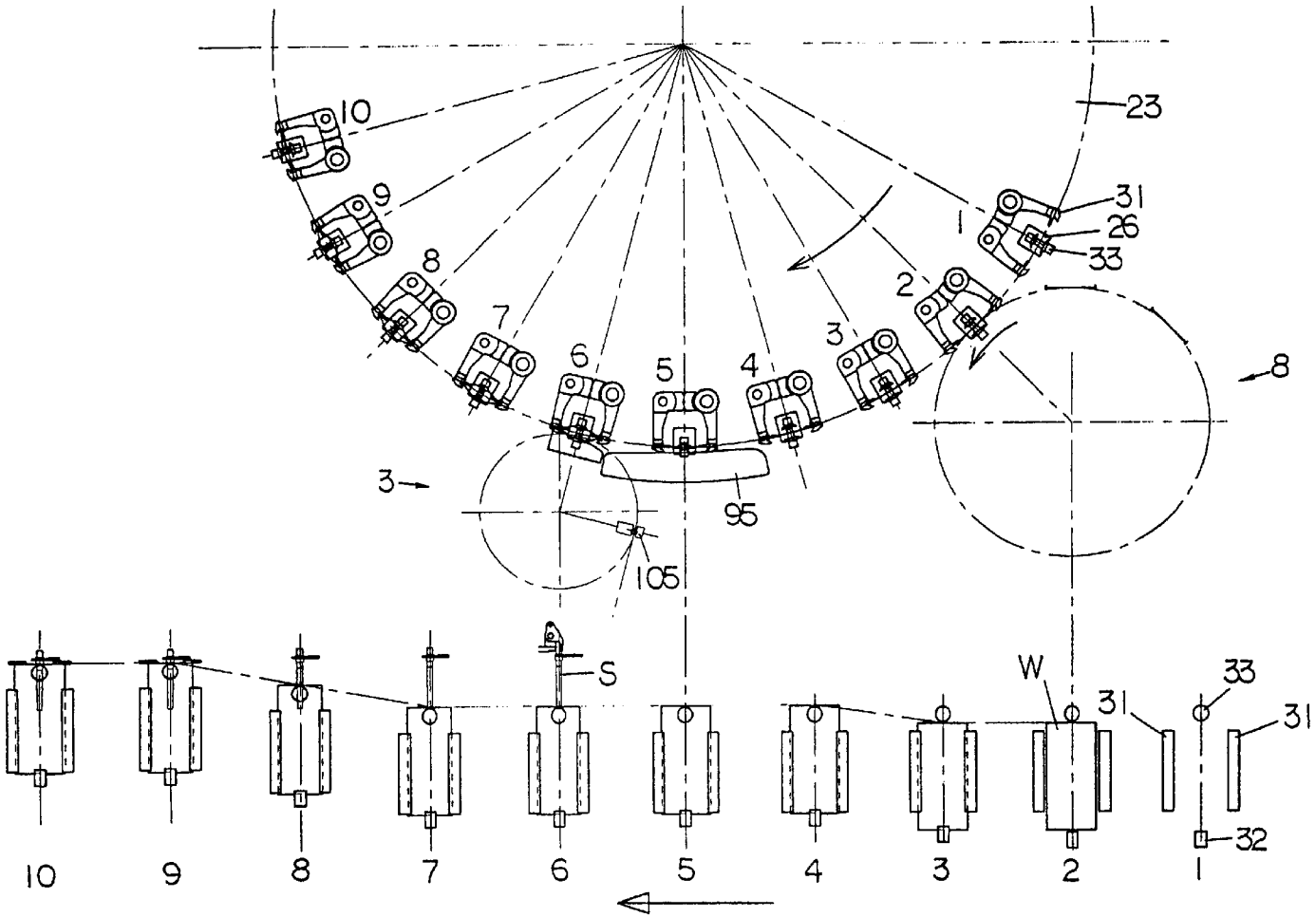
FIG. 9 illustrates the operation of the spout insertion apparatus.

The operation of the spout insertion apparatus 2 will be described with reference of FIG. 9. The numbers in parentheses below more or less correspond to the numbers 1 through 10 shown in FIG. 9.

(1~2) When the continuously rotating transfer means 9 of the transfer device 8 chuck the bags W held by the bag conveying device 6 and rotate by approximately 518 of a revolution so that the transfer means 9 approach the holding members 31 of the similarly continuously-rotating rotating table 23, the bags W make rubbing contact with the bag introduction guides 36 and 37, so that the bags are guided toward the holding members 31. At the same time, the transfer means 9 are connected to the atmosphere-release port 17 so that suction is stopped; as a result, the bags W chucked by the transfer means 9 to this point are respectively introduced into the gaps between the inner claws 31*a* and outer claws 31*b* of the facing holding members 31. Needless to say, the opening of the pairs of holding members 31 is set so that the gap between the two outer claws 31*b* is greater than the bag width (see FIG. 10A(*a*)). However, the gap between the two inner claws 31*a* is always less than the bag width.

Figure 10A:
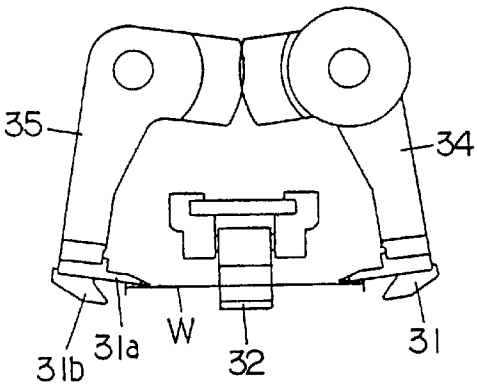
FIGS. 10A(*a*) through 10B(*c*) illustrate the operation of the holding members used in the present invention.
Figure 10A:
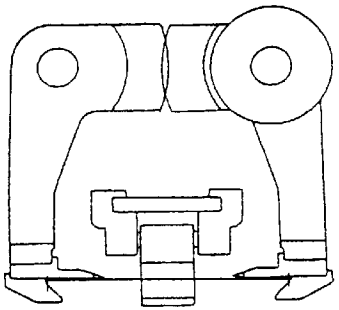
Figure 10A:
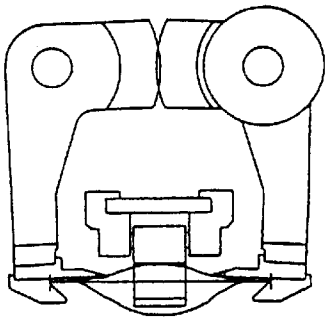

(3) The pair of holding members 31 are closed (in the direction of width), so that the gap between the V-shaped valley parts becomes approximately the same as the bag width, and both side edges of the bags W are thus held (see FIG. 10A(*b*)). Furthermore, the bag bottom receiving stand 32 begins to rise and receives the lower end of the bag W.

(4) The bag bottom receiving stand 32 rises further, and positions the mouth of the bag W at an intermediate point between the suction plates 33. The suction plates 33 initiate a suction action at this point.

(5) The cam roller 94 contacts the opening arm swinging cam 95, and the suction plates 33 close and chuck both surfaces of the bag W.

(6) The cam roller 94 separates from the opening arm swinging cam 95, and the suction plates 33 open, so that the bag mouth is opened. At the same time, the holding members 31 are closed further inward (in the direction of width), so that both side edges of the bag are held in accordance with the reduction in the width of the bag that occurs when the mouth of the bag is opened (see FIG. 10A(*c*)). Meanwhile, a spout S is supplied to the spout holding member 26 from the gripping claws 105 of the spout supply device 3.

Figure 10B:
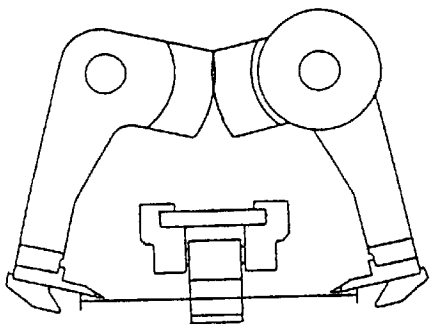
Figure 10B:
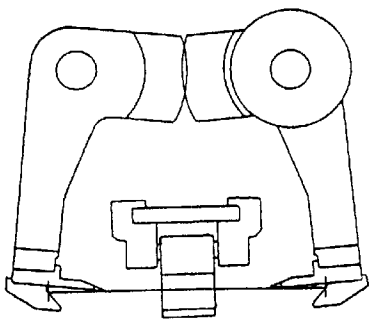
Figure 10B:
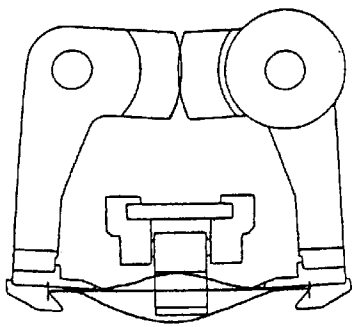

Furthermore, if the bag width should be widened from the state shown in FIGS. 10A(*a*) through 10A(*c*), the opening and closing action is performed in a state in which the spacing of the holding members 31 is widened as shown in FIGS. 10B(*a*) through 10B(*c*). The degree of this opening and closing (margin in the direction of width) is more or less fixed regardless of the bag width.

(7~9) The raising-and-lowering holder 41 and the receiving stand holder 72 begin to rise at the same time, and the holding members 31, suction plates 33 and bag bottom receiving stand 32 begin to rise at the same time. As a result, both side edges of bags W whose mouths have begun to be opened are held by the holding members 31, and the bags W are raised vertically in a state in which the center of the bag in the direction of width is positioned at the center of the spout S, so that the bag is fitted over the spout S. During this period, the suction plates 33 cease to apply suction at the point where the upper end of the bag W crosses the lower end of the sealing portions f of the spout S, so that the bag W is released. Furthermore, an insertion apparatus in which the holding members are not raised and lowered is also conceivable; in this case, the holding members function as guides that guide the raising and lowering of the bags.

The raising-and-lowering holder 41 and the receiving stand holder 72 rise and stop in a set position; this position is set so that the upper end of the bag W contacts the attachment plate 25 (which functions as a contact member that restricts the rising end of the bag) and stops immediately prior to the stopping of the abovementioned parts. When the bag W stops, the bag bottom receiving stand 32 simultaneously ceases any further rise; on the other hand, the raising-and-lowering holder 41 and receiving stand holder 72 continue to rise slightly to a set position, and the rise of the receiving stand holder 72 is absorbed by the compression spring 74. The reason for using such an arrangement is to allow accurate positioning of the upper end of the bag W at the upper end of the sealing portions of the spout S even if there is some variation in the length of the bags W. Such variation in the length of the bags W is absorbed by the elastic deformation of the compression spring 74.

(10) The bags W and spouts S are rotationally conveyed to the temporary-sealing apparatus 4 in a positioned state.

As seen from the above, according to the present invention, movable components are disposed beneath the spouts, and only a few movable components are disposed above the spouts; accordingly, the adhesion of falling dirt and oil droplets to the spouts and/and bags can be prevented. In addition, accurate positioning of the bags and spouts can be accomplished, and positional deviation during sealing or temporary sealing can be prevented.

What is claimed is:

1. A spout insertion apparatus which inserts spouts into specified positions inside bags, wherein said spout insertion apparatus is comprised of:

a plurality of spout holding members disposed at equal intervals on a circumference of a continuously rotating rotor so as to hold supplied spouts vertically in specified positions;

a pair of holding members, a bag bottom receiving stand, and a chucking member which are respectively disposed beneath each of said spout holding members, said pair of holding members positioning and holding bet side edges of supplied bags, said bag bottom receiving stand supporting lower ends of said bags, and said chucking member opening mouths of said bags by applying suction from both sides; and a raising-and-lowering means which raises and lowers either one of said bag bottom receiving stand or said chucking member, or both of them, and wherein said spout holding members, the pair of holding members, the bag bottom receiving stand, and the chucking member are rotated together with the rotor;

said pair of holding members set said bags upright;

said raising-and-lowering means raises the lowers the bag bottom receiving stand and the chucking member when the rotor is rotated;

said mouths of said bags with side edges of said bags being held by said holding members and lower ends of said bags being supported by said bag bottom receiving stand are opened from both sides by an application of suction by said chucking member;

said bag bottom receiving stand and/or said chucking member are raised vertically with said mouths of said bags in an open state, so that said bags are raised to upper ends of sealing portion of spouts; and further comprising a raising-and-lowering means which raises and lowers said holding members, wherein said mouths of said bags with side edges of said bags being held by said holding members and lower ends of said bags being supported by said bag bottom receiving stand are opened from both sides by an application of suction by said chucking member, and said holding members and said bag bottom receiving stand and/or said chucking member are raised vertically with said mouths of said bags in an open so that said ha are raised to upper ends of said sealing portions of said spouts.

2. The spout insertion apparatus according to claim 1, wherein when said chucking member opens said mouths of said bags by applying suction from both sides, said pair of holding members narrow a gap between said holding members by a specified distance.

3. A spout insertion apparatus which inserts spouts into specified positions inside bags, wherein said spout insertion apparatus is comprised of:

a plurality of spout holding members disposed at equal intervals on a circumference of a continuously rotating rotor so as hold supplied spouts vertically in specified positions;

a pair of holding members a bag bottom receiving stand and a chucking member which are respectively disposed beneath each of said out holding member said air of holding members positioning and holding both side edges of supplied bags, said bag bottom receiving stand supporting lower ends of said bags and said chucking member opening mouths of said bags by applying suction from both sides; and a raising-and-lowering means which raises and lowers either one of said bag bottom receiving stand or said chucking member, or both of them, and wherein said mouths of said bags with side edges of said ban being held by said holding members and lower ends of said bags being supported by said bag bottom receiving stand are opened from both sides by an application of suction by said chucking member, and said bag bottom receiving stand and/or said chucking member are raised vertically with said mouths of said bags in an open state, so that said bags are raised to upper ends of sealing portion of spouts;

further comprising a raising-and-lowering means which raises and lowers said holding members, wherein said mouths of said bags with side edges of said bags being held by said holding members and lower ends of said bags being supported by said bag bottom receiving stand are opened from both sides in an application of suction by said chucking member, and said holding members and said bag bottom receiving stand and/or said chucking member are raised vertically with said mouths of said bags in an open state, so that said bags are raised to upper ends of said sealing portions of said spouts.

4. The spout insertion apparatus according to claim 3, wherein a common raising-and-lowering means is provided which simultaneously raises and lowers said holding members and said chucking member.

5. The spout insertion apparatus according to claim 3 or 4, wherein a raising-and-lowering means is provided which raises and lowers said bag bottom receiving stand, and wherein said mouths of said bags are opened from both sides by said chucking member after said bag bottom receiving stand that supports said lower ends of said bags has been raised a specified distance so as to raise said mouths of said bags to a position of said chucking member.

6. The spout insertion apparatus according to claim 5, wherein:

raising-and-lowering means which raise said bag bottom receiving stand and said chucking member are provided for both of them, and wherein a contact member which contacts upper ends of raised bags is disposed in lower portions of said spout holding members, said bag bottom receiving stand elastically supports said bags, and a suction chucking of said chucking member is stopped immediately before said bags reach said upper end.

7. The spout insertion apparatus according to claim 3 or 4, wherein:

raising-and-lowering means which raise said bag bottom receiving stand and said chucking member are provided for both of them, and wherein a contact member which contacts upper ends of raised bags is disposed in lower portions of said spout holding members, said bag bottom receiving stand elastically supports said bags, and a suction chucking of said chucking member is stopped immediately before said bags reach said upper end.

8. A spout insertion apparatus which inserts snouts into specified positions inside bags wherein said spout insertion apparatus is comprised of:

a plurality of snout holding members disposed at canal intervals on a circumference of a continuously rotating rotor so as to hold supplied snouts vertically in specified positions;

a pair of holding members a bag bottom receiving stand and a chucking member which are respectively disposed beneath each of said scout holding members, said pair of holding members positioning and holding both side edges of supplied bags, said bag bottom receiving stand supporting lower ends of said bags and said chucking member opening mouths of said bags by applying suction from both sides; and a raising-and-lowering means which raises and lowers either one of said bag bottom receiving stand or said chucking member or both of them, and wherein said holding members have a substantially V shape as seen in a plan view and have a specified length in a vertical direction;

said holding members are attached to tip ends of respective pivoting arms and are disposed facing each other, open and close by swinging through a specified range, and receive bags when said holding members are open and then close to bold both side edges of said bags;

said mouths of said bags with side edges of said bags being held by said holding members and lower ends of said bags being supported by said bag bottom receiving stand are opened from both sides by an application of suction by said chucking member, and said bag bottom receiving stand and/or said chucking member are raised vertically with said mouths of said bags in an open state so that said bags are raised to inner ends of sealing portion of spouts.

* * * * *